United States Patent [19]

Olofsson

[11] 4,077,442

[45] Mar. 7, 1978

[54] ARRANGEMENT IN LIQUID SPRAYER CONTAINERS

[75] Inventor: Sigfrid M. Olofsson, Munkedal, Sweden

[73] Assignee: AB Malte Sandgren, Sandared, Sweden

[21] Appl. No.: 722,726

[22] Filed: Sep. 13, 1976

[30] Foreign Application Priority Data

Aug. 10, 1976 Sweden ..... 7608916

[51] Int. Cl.[2] ..... B67D 5/54

[52] U.S. Cl. ..... 141/20; 222/402; 239/357; 239/373; 239/579

[58] Field of Search ..... 239/337, 357, 360, 373, 239/579; 222/401, 402; 141/20

[56] References Cited

U.S. PATENT DOCUMENTS 2,890,817 6/1959 Rheinstrom ..... 239/373 X 3,282,510 11/1966 Van Schwartz ..... 239/373

*Primary Examiner*—Evon C. Blunk
*Assistant Examiner*—Michael Mar
*Attorney, Agent, or Firm*—Harness, Dickey & Pierce

[57] ABSTRACT

An arrangement in liquid sprayer containers designed to form an excess pressure inside the containers so as to allow the liquid contained therein to be discharged through a nozzle in the form of a spray. The arrangement inclues a head provided with a manually operable valve mechanism. The nozzle is in communication with the valve mechanism and arranged, upon opening of the valve, to discharge the liquid in atomized form. A cap encloses the head and when forced downwards it compresses the air in the space enclosed by the cap, whereby the valve opens a passage allowing the excess pressure to propagate into the container. Upon elimination of the excess pressure the valve mechanism again closes the passage.

18 Claims, 8 Drawing Figures

ARRANGEMENT IN LIQUID SPRAYER CONTAINERS

BACKGROUND OF THE INVENTION

The present invention relates to an arrangement in liquid sprayer containers, such as bottles of glass or metal cans, wherein a liquid is contained under excess pressure and which are equipped with a mechanism for discharging the liquid in an atomized form, i.e. in the form of a spray.

The most common liquid containers of this kind are the so called aerosol cans wherein the liquid is kept under pressure with the aid of a propulsion or dispersion gas. Although their function is completely satisfactory these aerosol cans still suffer from several drawbacks. For instance, since these cans are in fact pressure vessels they constitute a safety risk under certain circumstances. Furthermore, when the container is being used, as gas, freon, is expelled together with the liquid being discharged, and this gas has proved to have very unfavourable pollutive effects on the atmosphere.

To eliminate these drawbacks a variety of constructions has been devised wherein the excess pressure necessary to atomize the liquid during the discharge thereof from the container is obtained at the very instance of use of the can or bottle. A common feature in these constructions is the provision of a head on the can or bottle which head is equipped with a mechanism including a valve and a pump. With the aid of this mechanism the liquid is dispersed in an atomized form from the container through a nozzle upon each pumping movement.

The advantage of an arrangement of this kind is the possibility to use an ordinary, conventional bottle which thus need not be a pressure vessel. However, with none of the prior-art constructions of this kind has it hitherto been possible to achieve that the liquid being discharged remains in a satisfactorily atomized form during the entire pumping movement. The moment of dispersion during each pumping movement furthermore is so short that as a rule it is rather complicated to carry out a continuous working operation when several successive pumping movements are required. In several prior-art devices the problem is badly solved constructively, with the result that the pump mechanisms may stick and the valves leak.

SUMMARY OF THE INVENTION

The purpose of the present invention is to provide a novel structure designed to eliminate the risks and drawbacks inherent in prior-art constructions. The arrangement in accordance with the invention generally refers to the kind of liquid containers, such as bottles, which are equipped with a head provided with a manually operable valve mechanism and a nozzle in communication with said valve mechanism and arranged upon opening of the valve mechanism, to discharge the liquid contained in the container under excess pressure in the form of a spray. The inventive object is characterized in that it comprises a cap enclosing the head and arranged, when forced downwards, to compress the air in the space enclosed by the cap, and in that the valve mechanism is arranged, upon formation of an excess pressure in said space, to open a passage and allow the excess pressure to propagate down into the container and, upon elimination of all the excess pressure or the major part thereof in this space, to again close said passage.

Further characteristics of the invention and the advantages to be gained thereby will become apparent upon reading of the following detailed description of prefferred embodiments.

BRIEF DESCRIPTION OF THE DRAWINGS

The invention will be described in the following in more detail with reference to the accompanying drawings, wherein.

DETAILED DESCRIPTIONS OF PREFERRED EMBODIMENTS

Figure 1:
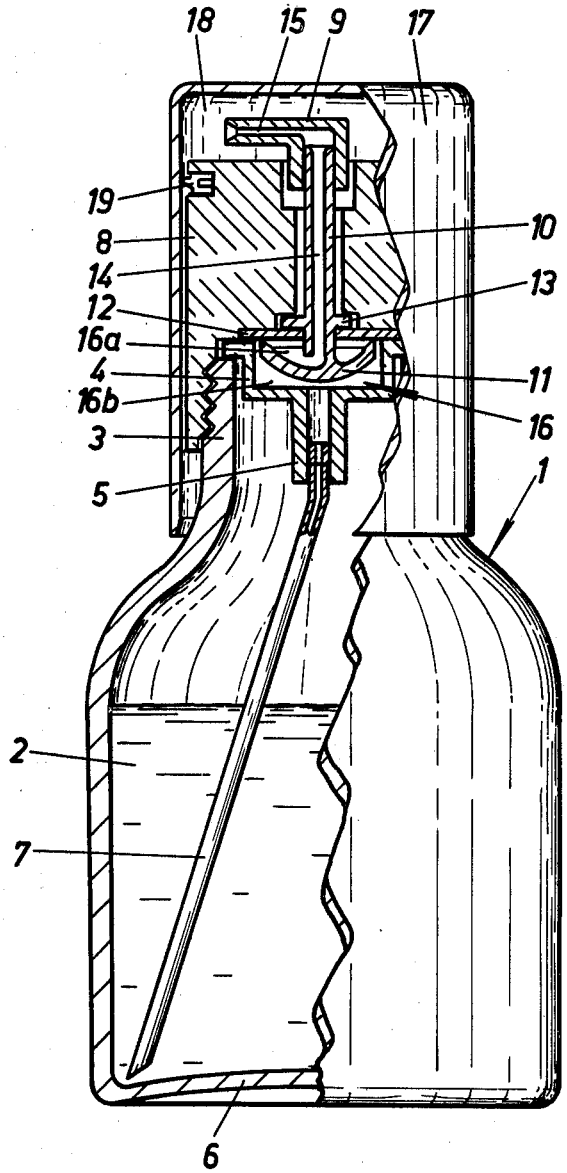
FIG. 1 illustrates in a partial longitudinal section a bottle equipped with the device in accordance with a first embodiment of the invention.

FIG. 1 illustrates a container, in this case a bottle 1 which is partly filled with a liquid 2. Into the bottle neck 3 is mounted an inset piece 4 in a position somewhat countersunk inside the bottle neck and provided at its lower portion with a pipe stub 5 to which is connected a pipe 7 extending towards the bottom 6 of the bottle.

A head piece 8 is threaded onto the bottle neck 3 so as to sealingly secure the inset piece 4 between the head piece and the bottle. A nozzle 9 is mounted for reciprocating movement at the upper face of the head piece. A pipe section 10 communicates the nozzle 9 with a valve mechanism. In accordance with the embodiment illustrated in FIG. 1 this valve mechanism comprises a dish-shaped seal 11 which in its neutral or unbiassed position sealingly abuts against a diaphragm 12. The diaphragm 12 is sealingly secured to the head piece 8 and to an annular flange 13 formed on the pipe section 10. A passageway 14 through the pipe section 10 communicates a passageway 15 which extends through the nozzle 9 with an area **16*a* enclosed by the seal 11 and forming part of valve chamber 16, the remaining area 16*b* of which communicates with the interior of the bottle 1**.

In accordance with the invention the device incorporates a cap 17 which is arranged to be mounted on the head piece 8 so as to enclose the latter. The cap could be designed in conformity with the conventional protective caps frequently used to enclose the screw stopper of bottles or the valve mechanism of cans. The cap 17 is arranged, when pressed downwards about the head piece 8, to compress the air in the space 18 then enclosed by the cap. Preferably, the head piece 8 is provided with a peripheral annular seal 19 serving to prevent leakage of air between the inner face of the cap 17 and the exterior of the head piece 8 during the building up of an excess pressure in the space 18.

Figure 4:
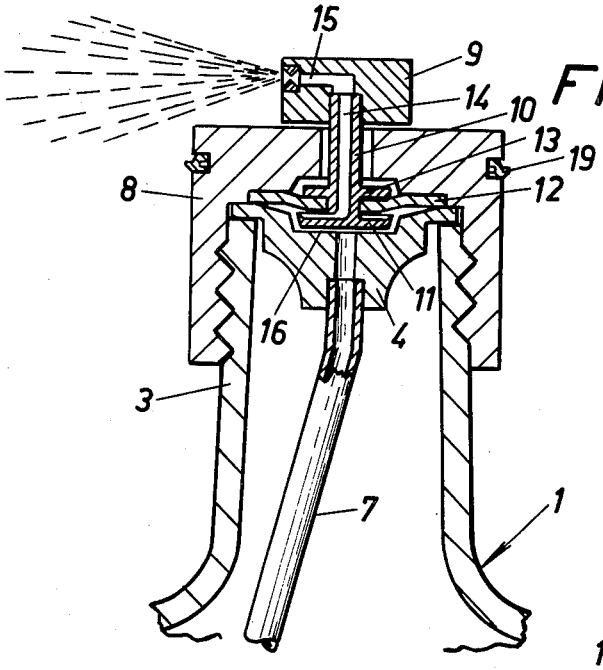
FIGS. 2–4 illustrate a second embodiment of the device in accordance with the invention in three different stages of use.
Figure 2:
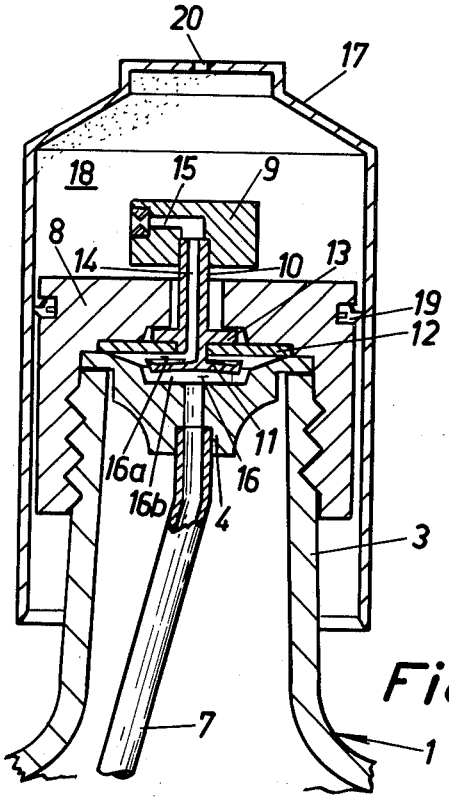
Figure 3:
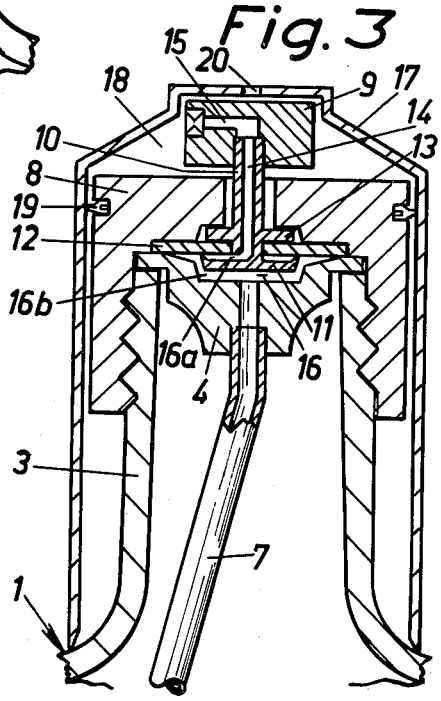

FIGS. 2–4 show an embodiment which in principle is not distinguished from the embodiment of FIG. 1 but differs therefrom only as regards the design of certain details incorporated in the device. For instance, the inset piece 4, the head piece 8, the nozzle 9, and the seal 11 differ in designs, and in addition, the whole nozzle is positioned on top of the head piece. Also the cap 17 has been given a different configuration so as to match that of the nozzle 9, as will be described more in detail in the following.

The function of the device will be described in the following with reference to FIGS. 2–4. FIG. 2 illustrates the position wherein the cap 17 has been pressed somewhat onto the head piece, whereby an excess pressure is formed in the space 18. Upon further depression of the cap 17, this excess pressure which propagates through the passageway 15 of the nozzle 9 and the communicating passageway 14 down to the seal 11, will force this seal away from its sealingly abutting position against the diaphragm 12. As a result, air will flow down into the lower section 16*b* of the valve chamber 16 and farther through the tube 7 into the interior of the bottle, where an excess pressure builds up. Preferably, the cap 17 is provided at its top with an aperture 20 which the operator, while depressing the cap, closes with one finger. When the cap has reached its lowermost position, the finger is moved away, exposing the aperture 20, whereby the excess pressure in the space 18 disappears. The excess pressure now existing in the bottle interior urges the seal 11 to abut against its seat, i.e. the diaphragm 12, and thus maintain the excess pressure inside the bottle (FIG. 3).

When the bottle is to be used as a spray bottle or atomizer bottle, the cap 17 is lifted off. Upon depression of the nozzle 9, the valve 11, 12 opens and liquid flows up through the pipe 7, the valve chamber 16, the communication passageway 14 and is discharged through the nozzle 9, as illustrated in FIG. 4. As soon as the pressure on the nozzle is relieved, the diaphragm 12 springs back and as a result, the engagement between the seal 11 and the diaphragm 12 is quickly restored.

The device as described possesses considerable and important advantages over prior-art techniques. During storage of the bottle 1, there is no need for an excess pressure inside it. When it is to be used, one lifts the cap 17 somewhat and then again depresses it about the head piece 8 to build up an excess pressure inside the bottle, then lifts off the cap from the bottle which is now ready to be used as an atomizer or spray bottle upon mere depression of the nozzle 9. Repeated short pumping movements during the spraying operation proper thus need not be effected. Instead the spraying operation may be carried out with the same simplicity as with an aerosol can. On account of the simple structure of the valve mechanism there is hardly any wear on the components. As a result, the sealing effect is maintained at a satisfactory level over a long time. This means that the bottle may be set aside having a (moderate and harmless) excess pressure and then be again taken out to be used directly as a spray bottle without any risk that the excess pressure will have leaked out in the meantime.

Owing to the provisions in accordance with FIGS. 2–4 with the nozzle 9 positioned wholly on the exterior of and above the head piece 8 and with the cap 17 given a shape in conformity therewith, a volume remains about the nozzle after maximum depression of the cap. This ensures that the pressure inside the space 18 cannot rise to a so called over-critical level, which would have been the case, had it been possible to depress the cap 17 fully into abutment against the upper face of the head piece 8.

Under certain circumstances it may be disadvantageous to bring air into direct contact with the liquid inside the container. This is particularly true when the liquid is of a kind that is negatively effected by air.

Figure 5:
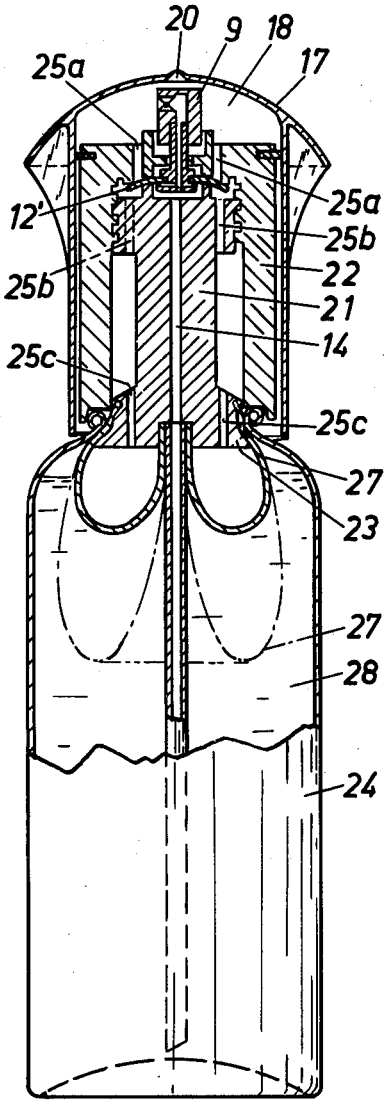
FIG. 5 shows in a vertical sectional view a third embodiment of the invention.
Figure 6:
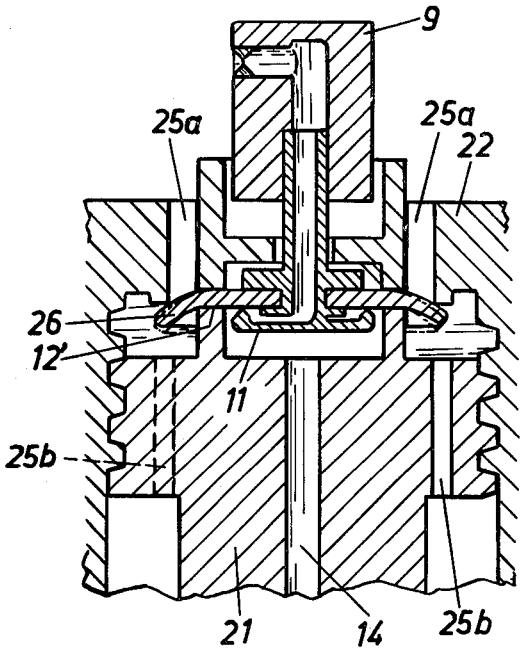
FIGS. 6 and 7 show on an enlarged scale central parts of the head in accordance with the third embodiment of the invention.
Figure 7:
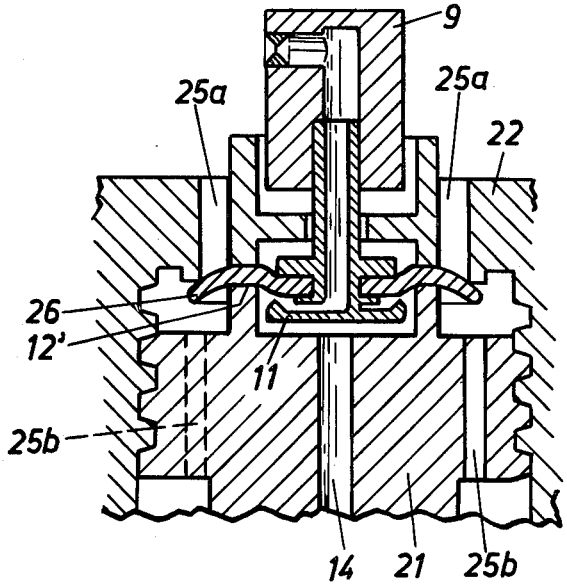

For the purpose of eliminating this problem the embodiment in accordance with FIGS. 5–7 has been devised. As appears from FIG. 5, the head piece in this case consists of one inner section 21 and one outer section 22. The inner section 21 through which extends the communicating passageway 14 is provided at its bottom with a wider portion 23 which may be inserted e.g. into a sheet metal can 24. The valve mechanism and the nozzle 9 are provided on the outer section 22, at the top thereof, and the unit thus formed may be threaded onto the inner section 21.

Two through-passage channels, each one divided into three sections 25*a*, 25*b* and 25*c*, respectively, extend through the two main sections 21, 22. The communication between the sections 25*a* and 25*b* is closed off by diaphragm 12' which is securely clamped between the two main sections 21, 22 screwed together and which in its normal position has its outer mariginal portion 26 abutting sealingly against the outer main section 22. In this position the valve likewise sealingly abuts against the diaphragm 12' with a force of engagement somewhat exceeding that of the marginal portion 26 of the diaphragm 12'.

About the wider portion 23 of the main section 21 is arranged in accordance with the teachings of the invention an inflatable liquid-tight bladder 27 which is intended to be inserted into the can 24 after the latter has been filled with the liquid 28 which is sensitive to air. When the outer main section 22 is screwed onto the inner section, the portion 23 of the latter will be urged upwards into contact with the mouth portion of the can and the wall of the bladder 27 will be sealingly clamped between the bladder wall and portion 23.

The device in accordance with this embodiment is used in a manner similar to those described with regard to the embodiments above. When the cap 17 is pressed downwards about the head section 21, 22 (with aperture 20 closed), and the air is compressed in the chamber 18, the valve 11 will not open but instead the marginal portion 26 of the diaphragm 12' will be turned downwards, as indicated in dash-and-dot lines in FIG. 6, allowing air to flow through the passageway sections 25*a*, 25*b*, and 25*c* down into the bladder 27, wherein the air pressure thus increases. As soon as the air pressure in chamber 18 sinks below the pressure in the bladder 27, the marginal portion 26 of the diaphragm 12' will close the through-passages 25*a*, 25*b*, 25*c*.

When the nozzle 9 is depressed, the valve 11 opens and liquid is expelled from the nozzle in spray form, see FIG. 7. While the liquid is streaming out, the bladder 27 expands (see FIG. 5), and at the same time the pressure therein sinks to a level approaching the atmospheric pressure. As a consequence, the bladder will fill out the can 24 gradually at the pace of consumption of the liquid 28. Air and liquid thus never get into contact with one another inside the can 24.

Figure 8:
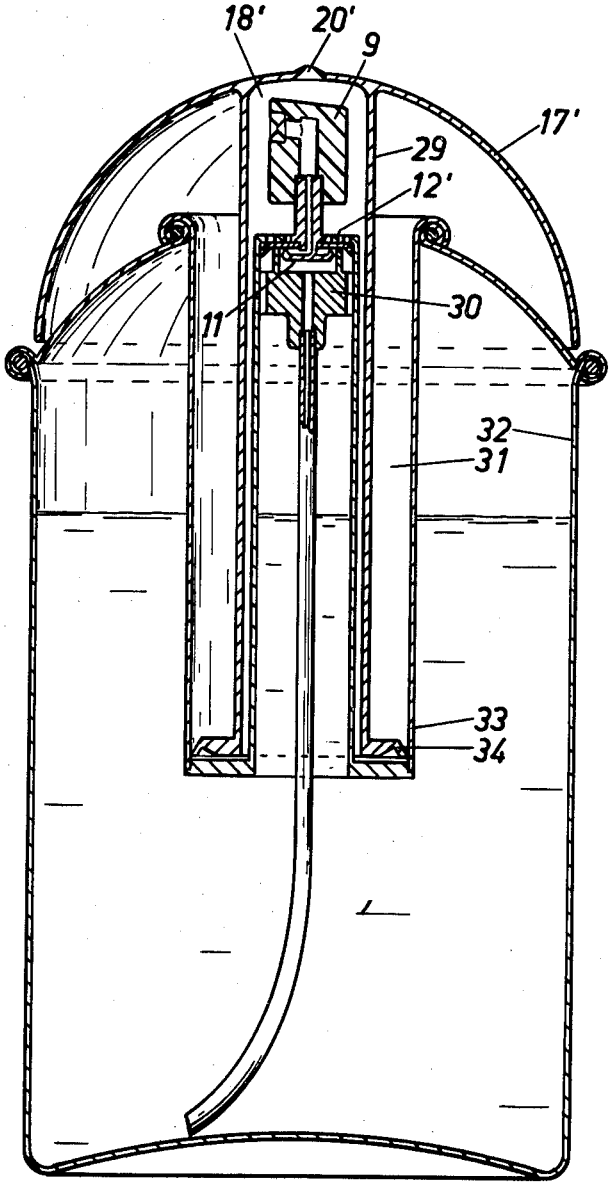
FIG. 8 is a vertical sectional view through the inventive object in accordance with a further development thereof.

Finally, the invention concerns a further development of the invention as illustrated in FIG. 8. It has been devised to fill the urgent need to apply the structural design of the device in accordance with the invention to liquid containers already existing on the market, primarily to metal cans manufactured on a large scale in the aerosol industry. The embodiment of FIG. 8 is distinguished from the one described previously in that on its inner face the cap 17' is provided with an elongate tube 29 which may be inserted into a channel 31 formed in the liquid container 32 and enclosing the valve head 30. In this case, the chamber 18' is formed between the head 30, the tube 29 and the cap 17'. At its free end, the tube 29 preferably is provided with a flange 34 arranged in sealing engagement with the walls 33 of the channel 31.

When the tube 29 is inserted into the channel 31, enclosing the head 30 (and the aperture 20' formed in the cap 17' is blocked), the air pressure will increase inside the chamber 18' to such an extent that the diaphragm 12', like in the embodiment just described, will open up the communication with the liquid container 32. In this case, air will penetrate straight into the container, just as is the case in the basic embodiment of the invention described initially, and an excess pressure is generated inside the container. The spraying operation takes place in a manner completely agreeing with that described with relation to the other embodiments of the invention.

On account of the particular design of the liquid container 32 and the cap 17' is gained the advantage that the container itself may be produced exactly like the spray cans of aerosol type already existing on the market and used in a variety of fields. Consequently, there is no need to develop new machines in order to manufacture cans that are adjusted to the device in accordance with the invention but the detail components incorporated in the device in accordance with the invention may be applied directly on a can of prior-art design.

The invention is not either limited to the embodiments as described and illustrated herein but may be modified in a variety of ways within the scope of the appended claims. The seal 11 as well as the nozzle 9 may be of a different design. If the fit between the cap 17 and the head piece 8 is good it is possible to dispense with the sealing ring 19 without significant reduction of the pumping effect.

Adjacent the aperture 20 on the inner face of the cap a lip-type seal of known construction may be arranged. Upon depression of the cap 17 on the head piece 8, this seal would serve to close the aperture 20 and upon raising of the cap let in air this way. This would obviate the need of keeping one finger on the aperture during the pumping, as described above.

Alternatively, it is possible to use a completely tight cap 17, as in FIG. 1. In this case, the sealing ring 19 should be designed in such a way that upon depression of the cap 17 (compression) an efficient blockage against air passage is formed between the cap and the head piece but upon removal of the cap air is let through into the gradually expanding chamber 18 for pressure levelling therein.

The annular seal 19 may be mounted on the inner face of the cap 17 instead of about the head piece 8.

What I claim is:

1. An improved spray-arrangement for liquid containers such as bottles comprising a closure for the bottle, a nozzle supported at least in part by said closure and having a discharge opening, a cap surrounding said closure and defining a space therebetween, said cap being movable relative to said closure for compressing air contained in said space, passage means interconnecting said space with the interior of said bottle and interconnecting the portion of said bottle containing the contents thereof with said nozzle discharge opening, and valve means for controlling the communication through said passage means, said valve means being adapted to open communication between said space and said bottle upon the generation of a pressure upon compression of air in said space for permitting said compressed air to be transferred to the portion of said bottle above its contents, said valve means being adapted to close communication of said space through said passage means when the pressure of the air in said space and the portion of said bottle above its contents are substantially equal, said valve means, upon removal of said cap being manually operable for movement to an open position for permitting discharge of the contents of said bottle through said nozzle discharge opening under the influence of the pressure of the compressed air in said bottle above its contents.

2. An improved spray arrangement as set forth in claim 1 further including an annular seal interposed between said cap and said closure for isolating said space from communication with the outside air upon movement of said cap relative to said closure.

3. An improved spray arrangement as set forth in claim 2 wherein the annular seal engages an internal face of the cap.

4. An improved spray arrangement as set forth in claim 1 wherein the valve means includes a single valve element manually operable to its opened position and operable to its opened position in response to the existence of a greater pressure in said space than in the interior of said bottle.

5. An improved spray arrangement as set forth in claim 4 further including a diaphragm sealingly secured to said closure, said nozzle being affixed to said diaphragm and sealed thereto, said passage means including a common passage extending through said diaphragm.

6. An improved spray arrangement as set forth in claim 5 wherein said diaphragm is resilient and acts to bias said nozzle to a normal position, said nozzle being supported for movement relative to said closure and comprising the manually operable portion of said valve means.

7. An improved spary arrangement as set forth in claim 6 wherein the diaphragm forms a seat with which said valve means element coacts.

8. An improved spray arrangement as set forth in claim 3 wherein said diaphragm is resilient and acts to bias said nozzle to a normal position, said nozzle being supported for movement relative to said closure and comprising the manually operable portion of said valve means.

9. An improved spray arrangement as set forth in claim 8 wherein the diaphragm forms a seat with which said valve means element coacts.

10. An improved spray arrangement as set forth in claim 5 wherein the valve means element comprises a resilient member having a lip portion sealingly engaged with said diaphragm, said lip portion being deflectable in response to a pressure differential between the space and the interior of the bottle for opening of said element upon such a pressure differential.

11. An improved spray arrangement as set forth in claim 1 further including an impervious resilient bladder extending across the bottle and being adapted to separate the air pressure exerted in said bottle above the contents thereof from the contents.

12. An improved spray arrangement as set forth in claim 1 wherein the passage means comprises a first passage interconnecting the space with the interior of the bottle and a second passage interconnecting the nozzle discharge opening with the contents of the bottle.

13. An improved spray arrangement as set forth in claim 12 further including an impervious resilient bladder extending across the bottle and being adapted to separate the air pressure exerted in said bottle above the contents thereof from the contents, said first passage terminating at one side of said bladder, said second passage terminating at the other side of said bladder.

14. An improved spray arrangement as set forth in claim 12 wherein the valve means comprises a first valve element for controlling the flow through said second passage and a second valve element for controlling the flow through said second passage.

15. An improved spray arrangement as set forth in claim 14 wherein one of the valve elements comprises a flexible diaphragm.

16. An improved spray arrangement as set forth in claim 15 wherein the first valve element comprises the flexible diaphragm, the nozzle being movably supported by the closure and being affixed to said diaphragm, the second valve element being affixed to said nozzle and having a lip portion adapted to engage said diaphragm for effecting a seal therewith, movement of said nozzle and deflection of said diaphragm being effective to cause said lip portion to move away from said diaphragm for opening said second passage.

17. An improved spray arrangement as set forth in claim 1 wherein the closure includes an elongated channel extending into the liquid container and defining an annular cavity, said cap having an elongated tube extending into said annular chamber and adapted to compress the air therein upon movement of the cap relative to the closure, said tube being spaced inwardly from the inner surface of said channel and said nozzle and said valve means being positioned radially inwardly of said tube.

18. An improved spray arrangement as set forth in claim 17 comprising a flange formed at the free end of said tube for forming a seal against the wall of the channel.

* * * * *